United States Patent [19]

Crone

[11] Patent Number: 4,463,878

[45] Date of Patent: Aug. 7, 1984

[54] CAP UNIT

[76] Inventor: Axel Crone, Ellekrattet 18, DK-2950 Vedbak, Denmark

[21] Appl. No.: 371,729

[22] Filed: Apr. 26, 1982

[30] Foreign Application Priority Data

Apr. 27, 1981 [DK] Denmark ..... 1860

[51] Int. Cl.[3] ..... B67B 5/00; B67D 5/32

[52] U.S. Cl. ..... 222/153; 222/182; 222/206; 222/568; 215/276

[58] Field of Search ..... 222/153, 182, 206, 420, 222/541, 562, 563, 568; 215/252, 256, 258, 276, 307

[56] References Cited

U.S. PATENT DOCUMENTS

| | | | |
|---|---|---|---|
| 2,392,507 | 1/1946 | Sebell | 215/256 |
| 2,415,609 | 2/1947 | Sebell | 215/256 |
| 2,470,057 | 5/1949 | Spender | 215/252 |
| 3,142,403 | 7/1964 | Fox | 215/256 |

FOREIGN PATENT DOCUMENTS

| | | | |
|---|---|---|---|
| 565649 | 3/1958 | Belgium | 222/562 |
| 1267887 | 3/1972 | United Kingdom | 222/568 |

*Primary Examiner*—H. Grant Skaggs
*Attorney, Agent, or Firm*—Quaintance & Murphy

[57] ABSTRACT

A cap unit for a container, which preferably is provided with a pliable dropper tube and comprising a cap for fastening directly on the container or thereon via a fastening part, may be secured against adulteration of the contents and may be permanently proofing before as well as after breaking of the security seal when the cap and the container neck or the fastening part in their mutual connection area comprise mutual cooperating complementary conical surfaces of a self locking conicity, and cooperating annular complementary engaging means, of which the one is performed of a resilient yieldable material integral with the cap or the fastening part via an annular weakening area. The fastening part may form a separate part of the container or may be manufactured in one piece with said container. The enclosing weakening area may be performed in the top of the fastening part or in the lower end of the cap. The cap may be provided with a foot due to which the container contents is safely enclosed although the cap is not properly mounted.

13 Claims, 10 Drawing Figures

CAP UNIT

Figure 1:
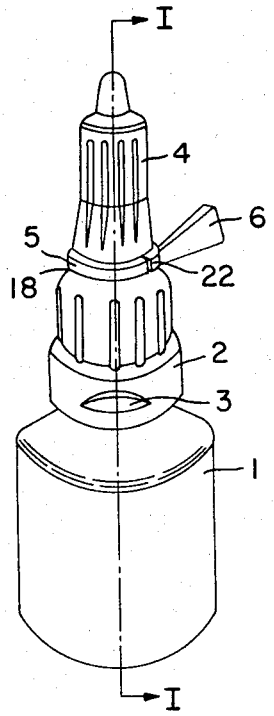

The present invention relates to a cap unit for a container, preferably provided with a pliable dropper or dropping tube and comprising a cap for fastening directly on the container or thereon via a fastening part.

According to the present invention the cap and the container neck or fastening part have a mutual connection area which comprises mutually cooperating, complementary conical surfaces of a self-locking conicity, and cooperating annular complementary engaging means, one of which is preformed of a resilient, yieldable material integral with the cap or the fastening part via an annular weakening area. Thereby a cap unit is achieved which is permanently tight fitting before as well as after breaking of the security seal and in case the fastening part forms an integrated part of the container, such as a tube, the container with a mounted cap unit is efficiently sealed against adulteration of the contents due to the combination of cooperating engaging means and cooperating conical surfaces. This is due to the fact that the cooperating conical surfaces cannot be disengaged without simultaneously turning of the cap relative to the fastening part and exerting a tractive force on the cap in a direction away from the fastening part. Said tractive force is immediately transferred through the engaging means to the weakening area which is broken thereby and reveals the adulteration or the attempt of same. Besides, the self-obstructing conicity protects the container contents against the access thereto of minor children as the turning and tractive movement of the cap is more complicated than an ordinary thread unscrewing movement. Removal or breaking of the security seal may take place by turning the cap with respect to the fastening part in case a complementary cogging on the engaging means prevents the mutual turning thereof, or by pulling a tearing off flap, whereby the engaging means connected thereto is loosened in the weakening area and reveals the cap for an easy turning and tearing or pulling off.

The fastening part may form a separate part, wherein the fastening part comprises a shirt arranged at the lower end thereof and opposite its conical part for abutment against the container, preferably the shoulder thereof, said shirt being provided with at least one, preferably at least two, radially inwardly and upwardly extending locking barbs for engagement with an annular bead or hook-shaped projection arranged on the outer surface of the container. The performance of the shirt and the barbs prevents the removal of the fastening part from the container. Thereby an efficient sealing against adulteration of the contents is also provided, although the fastening part does not form an integrated part of the container, as, of course, the locking barbs are so performed that pointed tools cannot enter behind a locking barb for the forcing out thereof without visibly to spoil the material of the fastening part whereby the adulteration will be revealed.

In principle, only one locking barb will be sufficient, but two barbs will further obstruct an attempt of sealing fraud. Moreover, the locking barb has the further function of blocking a possible thread connection between the container and the fastening part, so that the fastening part will not be screwed off the container when it is desired to remove the cap after removal of the cap sealing by turning of the thread in question in the unscrewing direction. In case the fastening part is made of a resilient yieldable material, said fastening part may have a radially inwardly directed fastening bead for engagement with a container neck below a crescent shaped bead enclosing said container neck. Also in this case the locking barb and the shirt prevents the removal of the fastening part from the container after the mounting of said fastening part.

An edge flange or a sealing collar may be wedged between the end surface of the container and the fastening part for the one end of a dropping tube having a narrow outlet channel and an outlet channel orifice at the opposite end. The cap internally comprises a centrally and rounded projection being adapted to the orifice as a closing plug thereof. The distance between the internal projection and an abutment of the fastening part in the mounted position of the cap are adapted to the distance of the orifice from the sealing collar at a non-folded length compressed position of the tube, so that the projection tightly closes the orifice when the two conical parts are in their self-locking mutual engagement. By this means, a tightly fitting enclosure of the container contents is further secured, also when the cap sealing is intact, e.g. during storing and transportation as well as during fluctuations in the ambient temperature, as the two cooperating sealings partly in the outlet of the dropping tube and partly in the conical connection of the cap unit increases the tight fit of the cap unit against over and underpressure. Before the seal is broken there may furthermore—because of the annular engaging means between the cap and the fastening part—be a third security seaing between the mutual contact faces of the means because of the aforesaid resilient material for at least the one engaging means.

The embodiment hereby achieved is suitable for containers containing precious liquids or liquids comprising easily evaporating components because of the double tightening after removal of the seal and during transportation or storing because of the triple sealing before removal of the security seal. Furthermore, the sealing at the conical parts is self-compensating for wear and tear, as the conical parts are self-obstructingly engaged before the lower edge of the cap abuts the fastening part. The closing with only two sealing locations thereby achieved—of course in excess of the sealing location between the container and the edge flange of the tube—will presumably by sterile container contents increase the safe storage time to at least one year as compared with three months for the prior known cap units with dropper tubes. One of the conical parts may have at least one annular cavity extending around its conical surface, thus the conical surfaces may be made longer without increasing the difficulty in breaking the seal and tearing off the cap, and simultaneously a dropper tube or the like elongated body such as a wick, a brush or a felt piece is better stiffened and secured in the conical part of the fastening part. The enclosing cavity decreases the self-locking effect a little, but in return it causes an increase of the fitting of the conical parts.

The annular engaging means with the weakening area may be provided with a tearing off flap or tag, and possibly a transverse weakening zone at the flap. The tearing off flap with the engaging means without the use of a transverse weakening zone may be released from the second locking and engaging means and may be removed in the form of a ring which is pulled outwardly and past or off the cap or the fastening part. When using a transverse weakening zone the engaging means may be removed as a pulled off strip piece by pulling the flap radially outwards which is easier than to loosen and remove the engaging means as a ring, and which allows the surrounding weakening area to be weakened for increasing the pressure in the third sealing between the engaging means. The transverse weakening zone may also be replaced by a transverse interruption of the engaging means by the tearing off flap, but thereby said third sealing is lost.

The engaging means may comprise complementary or mutually cooperating coggings, preferably saw tooth coggings with such a tooth inclinings direction that the coggings, when the the cap is turned in a possible unscrew direction for the fastening part, jumps over without the means being brought out of their mutual engagement. The security seal between the cap and the fastening part is also broken by a purely relative turning between the cap and the fastening part without exerting a tractive force thereon or any need for a tearing off flap and by a saw cogging and a female thread in the fastening part the sealing may be broken only by a relative turning of the cap and the fastening part in the turning direction required for screwing the fastening part on the container thread for a pressure increase of the edge flange sealing.

The cap may be a so-called foot cap on which the cap with a mounted fastening part and/or container may be placed in a turned vertical position. Thus is achieved firstly a better grip in the cap for breaking the seal between the cap and the fastening part, secondly a more secure assembly of the conical parts, and thereby a greater self-locking effect and sealing ability, and thirdly a greater torque for disengaging the cap from the fastening part. Moreover, a further effect is achieved, namely that a paste-like container contents which is easily destroyed by atmospheric air gets a longer durability when a foot cap is used, as only the amount of air corresponding to the outflowing amount of paste needs to be sucked into the container. The high self-locking abiity of the conical parts provides a good sealing against undesired outlet of the contents and high connection strength in the joint of the conical surfaces by a possible tipping over of the capped container. Furthermore, the use is facilitated compared to threaded caps as it only needs to be turned a fraction of a turn to be released. Furthermore, the conical part also provide a good sealing of the foot cap against outlet of the container contents, although the cap may be carelessly placed on the fastening part before the vertical positioning thereof as the weight of the container and its contents forces the conical parts against each other for providing a better proofing than if a threaded and loosely placed foot cap was used.

Figure 4:
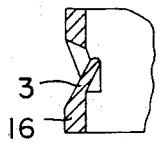

The invention will now be explained in more detail in connection with some embodiments and with reference to the drawing in which FIG. 1 shows a container provided with an embodiment of the cap unit according to the invention, FIG. 2 a section along l—l through the upper part of the container of FIG. 1, FIG. 3 an axial section through the cap unit at a larger scale, FIG. 4 a section through a locking barb for securing the fastening part to the container, FIG. 5 an axial section through an embodiment of the cap, FIG. 6 an axial section through a cap unit wherein the container neck is conical, FIG. 7 an axial section through a cap unit wherein the tearing off flap is integrated in the cap, FIG. 8 in a half axial section a cap which is provided with a foot cap, FIG. 9 a detail of an engaging means with a cogging, and FIG. 10 a detail at a larger scale of an embodiment with two joining steps for the conical parts.

FIG. 1 shows a container, such as a bottle 1, which is provided with a cap unit according to the invention. In this case the cap unit comprises a fastening part 2 adapted to be fastened on the container 1 by means of a female thread not shown, and a locking barb 3 as well as of a cap 4. At the top the fastening part 2 is provided with a tearing off strip 5 which is provided with a tearing off flap or tag 6, and with an annular weakening area 18 and possibly with a transverse weakening zone 22.

Figure 2:
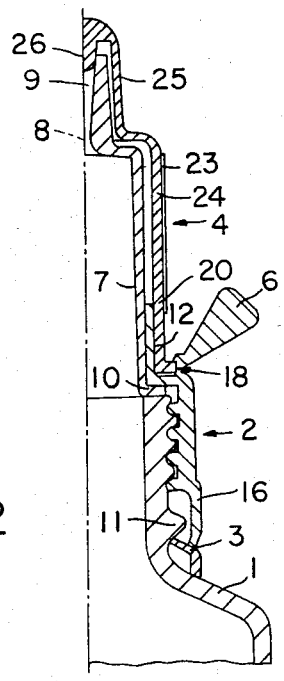

FIG. 2 shows a detail of the section l—l in FIG. 1 through the cap unit according to the invention, which is arranged at the top of the container 1. Here a cap unit is provided with a known resilient or pliable dropping tube 7 with a narrow outlet channel 8 and outlet channel orifice 9 and an edge flange or sealing collar 10 which is wedged in between the end surface of the container 1 and the fastening part 2. It also appears how the locking barb 3 at its root comprising a weakening area, is in engagement with an annular container bead 11 for securing the fastening part 2 to the container 1. An attempt of unscrewing the fastening part 2 after said part having been mounted on the container neck 1 will result in the breaking of the locking barb 3 at its weakening area for revealing a possible attempt of adulteration of the container contents. A conical part 12 is arranged on the fastening part 2 at the top and radially innermost, said conical part 12 having an outer conical surface for the engagement with an inner conical surface on the correspondingly performed conical part 20 in the lower end of the cap 4. As also will appear from FIG. 1, a number of longitudinal ribs 23 for facilitating the grip in the cap 4 is provided on the cap. As shown in FIG. 1 the fastening part 2 is also provided with such longitudinal ribs so that the fastening part 2 may offer resistance when it is desired to turn or pull off the cap 4 from the fastening part. Immediately above its conical part 20 the cap 4 is performed as a cylindrical tube part 24 which at its top turns into a slightly conical and narrower tube part 25 at the top end of which closing plugs 26 is arranged inside the cap for close fit closing of the outlet channel orifice 9 in the dropper tube 7.

As will be seen, in their mutual connection area the cap 4 and the fastening part 2 comprise cooperating and complementary conical surfaces in the conical parts 12, 20. According to the chosen material of the conical surfaces the conicity is chosen so that the conical surfaces becomes self locking as in the case e.g. by a Morse taper. Besides, the cap and in this case the fastening part is provided with cooperating, complementarily performed annular locking or engagement means 19, 21 as it more clearly appears from FIGS. 3 and 5, of which means the one 19 is performed of a resilient yielding material being an integral part of the fastening part 2 via an annular weakening area 18. In the embodiment shown in FIGS. 1-5, and in the embodiment shown in FIG. 6, the fastening part 2 forms a part separated from the container 1, and in this case the fastening part 2 comprises a shirt 16 at the lower end thereof for resting against the container, in this case against the shoulder thereof, said shirt 16 being provided with at least one, preferably, as shown in FIG. 3, two radially inwardly and upwardly extending locking barbs 3 as it more clearly appears from FIG. 4, for the engagement with the annular container bead 11 which, however, may also be performed as a hook shaped projection for further securing of the engagement with the locking barb 3.

Figure 3:
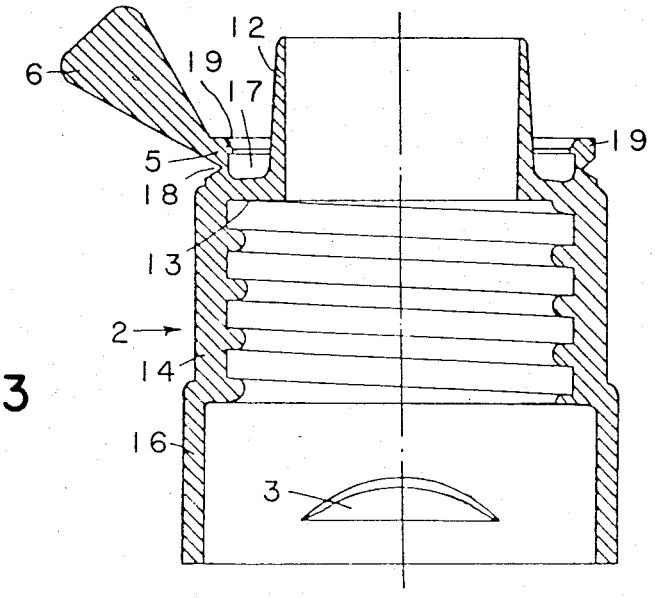

As also will appear from FIG. 2, in the mounted position of the cap the distance between the inner projection or the closing plug 26 and the abutment 13 of the fastening part 2 shown in FIG. 3, is adapted to the distance of the orifice 9 from the sealing collar 10 of the dropper tube when the tube 7 is positioned in a non-folded and slightly length-compressed position so that the closing plug 26 tightly close the orifice 9 when the two conical parts 12, 20 are in a self locking mutual engagement. Thereby sealing surfaces for the container contents is provided firstly at the orifice 9, secondly at the sealing collar 10, thirdly between the cooperating conical surfaces of the conical parts 12, 20, and possibly fourthly also between the cooperating locking means 19 and 21.

As shown in FIG. 3 the fastening part 2 comprises a threading part 14 having a female thread corresponding to a male thread on the container 1, and an abutment 13 cooperating with the end of the container 1 for wedging in the sealing collar 10 as will appear from FIG. 2. FIG. 3 shows an annular recess 17 below the annular downwardly and inwardly directed locking means 19 on the fastening part 2. Said recess 17 is necessary for the engagement between the locking means 21 on the cap 3 and the annular locking hook 19. Instead of the female thread of the part 14 the fastening part 2 may have one or two annular grooves for a locking engagement with one respectively two outer annular beads on the neck of the container 1 instead of a locking engagement with the male thread of the container 1. By a spring effect between the beads and the grooves the fastening part 2 of a resilient material may then be fastened to the container neck during a simultaneous fixing or clamping of the sealing collar 10 in a sealing arrangement against the neck end surface of the container 1.

Figure 6:
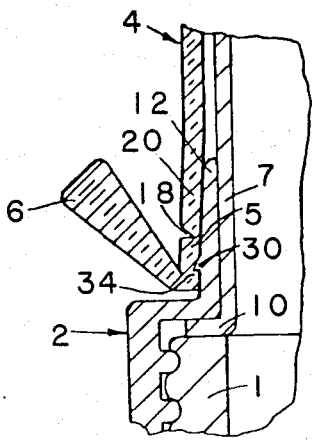

FIG. 6 shows another embodiment wherein the tearing off strip 5 with the tearing off tag 6 is performed in one piece with the cap 4 via the weakening area 18 so that in this case at least the cap 4 has to be performed of a resilient yielding material in order to allow the locking means to be engaged during the mounting of the cap. Here the fastening part 2 is provided with an annular downwardly and outwardly directed engaging means 30 instead of the engaging means 19 while the cap 4 and the tearing off strip 5 is provided with an annular, upwardly and inwardly directed engaging means 34 for engaging the means 30. Because of the positioning of the weakening area 18 above the means 34 and the cavity thereof to receive the means 30 the cap after tearing off of the tearing off strip 5 will be displaceable further downward along the conical part 12 for a further sealing or for compensation of tear and wear between the conical parts 12, 20.

Figure 7:
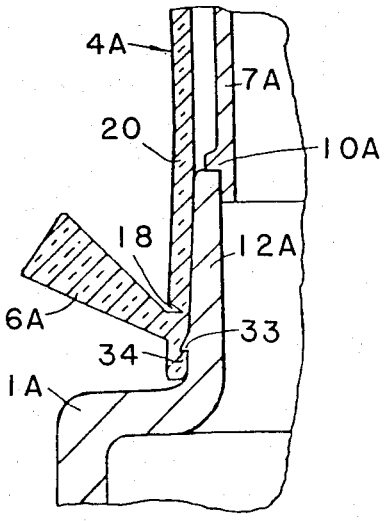

FIG. 7 shows a further embodiment wherein the fastening part 2 is omitted, wherein, however, the container 1A is performed with a corresponding conical part 12A for engaging the conical part 20 of the cap 4A. The engaging means 34 in the cap 4A and 33 in the neck of the container 1A are arranged in the same way as the engaging means shown in FIG. 6. Thereby the advantage of the invention by a sealed and tightened connection between the container 1A and the cap 4A is achieved. Contrary to what is shown in FIG. 6, the tearing off wing 6A of the embodiment shown is arranged immediately against the weakening zone 18. Furthermore, a dropper tube 7A of a different shape is used, said dropper tube is provided with an edge flange 10A to be adhered to the end of the conical part 12A. Thereby a very simple cap unit according to the invention is achieved, said unit only comprises the cap 4A per se.

Figure 5:
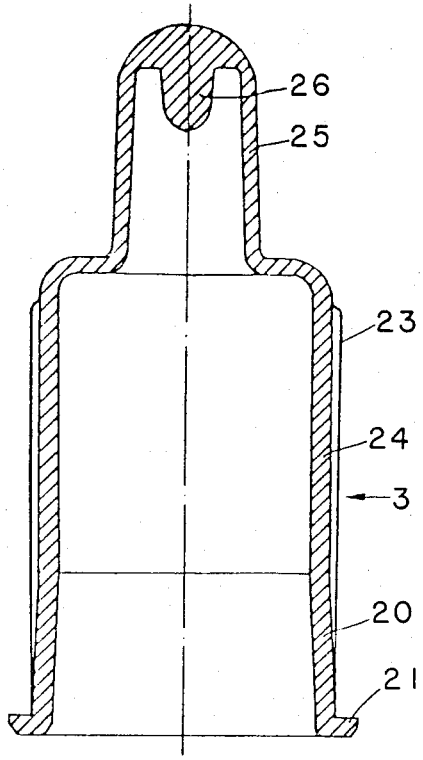
Figure 8:
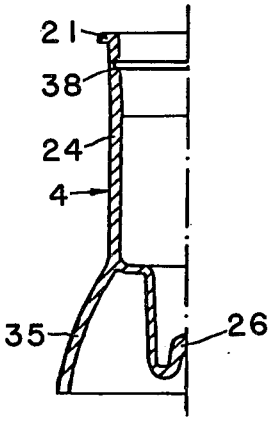

FIG. 8 shows a cap corresponding the cap shown in FIG. 5, however, provided with a foot 35 and a material saving performance of the closing plug 26. Thereby the weight of the container and of the container contents will contribute to the sealing of the sealing locations at the closing plug 26 as well as between the conical parts if a user erroneously has not fastened the conical parts to each other after the use of the container, so that the sealing surface between the conical parts is maintained. FIG. 8 also shows an annular cavity 38 in the conical surface of the cap 4. Said cavity facilitates the removal of the cap 4 from the conical part of the fastening part 2 or on the container 1A without a deterioration of the sealing ability.

Figure 9:
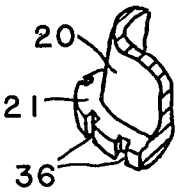

FIG. 9 shows a detail of the engaging means 21 of the cap, said means being provided with grooves 36 for engagement with corresponding teeth below the means 19 in the fastening part 2. Thereby the engaging means comprise complementary and mutually cooperating coggings which, not only as shown in FIG. 9, may be rectangular, but may also be saw tooth shaped with such inclining direction that the coggings when the cap is turned in a possible unscrew direction for the fastening part, jumps over without the hook means 19 and 21 being brought out of their mutual engagement.

Figure 10:
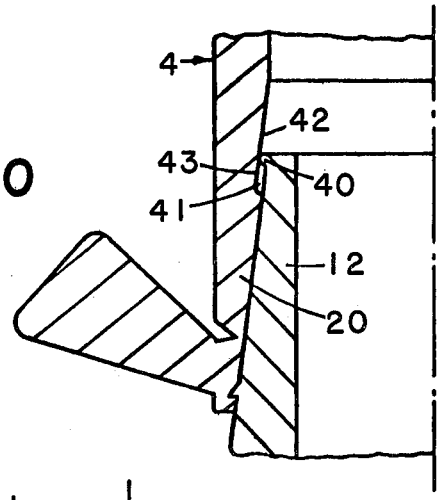

In the embodiment shown in FIG. 10 one of the conical surfaces of the conical parts 12 or 20 comprises an annular bead 40 which in the mutual self locking position of the conical surfaces is disposed with one or two clearances 41, 42 in a corresponding annular cavity 43 in the second conical surface. Thereby the cap 4 may be mounted on the conical part 12 of the fastening part 2 or on the conical part 12A of the container 1A in one or two operation steps, voluntarily. In the first step the bead 40 engages the cavity 43 at the lower end thereof at 41 and the cap 4 is secured with a small locking power between the bead 40 and the cavity 43. However, in the second step the two conical surfaces enter into a mutual self locking engagement after the two conical parts 12, 20 or 12A, 20 have been mutually turned during their joining. In the second step the bead 40 and the cavity 43 are disengaged or not further engaged because of the presence of the clearance 41, 42. It would be obvious to one of ordinary skill that this annular bead (40) and annular cavity (43) arrangement shown in FIG. 10 could be provided on the conical portion (20) of the inner surface of the cap (3) shown in FIG. 5 and the outer surface of the conical portion (12) of the fastening part (2) shown in FIG. 3 thereby obtaining the same type of two step engagement as would be obtained using the embodiment of FIG. 10.

With a mounted dropper tube and possibly also with a fastening part the container 1 may be autoclaved, unless the fastening part is performed in the container per se, and after mounting of the cap according to the invention the container 1 is efficiently sealed and proof, not only at the edge flange or 10A and at the dropping tube orifice 9, but also at the conical part 20 of the cap.

In case a dropper tube is not incorporated, an efficient sealing and safety seal against adulteration at the conical part 20 of the cap is achieved according to the invention. The cap unit according to the invention is suitable for containers for sterile liquids, such as eye drops, nose drops, antiseptic liquids, ear drops, vitamine preparations, liquid soaps, Indian ink, ordinary ink, browning, perfume, benzine and for other purposes for which a dropwise dosage is desired. Without a dropper on the container the cap unit is suitable for closing and security seal of eye ointments or ointments tubes in common, tooth paste tubes, glue tubes and for spirit pencils, where a guarantee for the contents being safely enclosed in the container and not partly being used during the goods demonstrations is desired.

Instead of "dropping tube" the term "dropper tube" is used in some instances, but the term "drop counter tube" might have been used as well.

What is claimed is:

1. A cap unit for a container, provided with a pliable dropper and comprising a cap for fastening on the container via a fastening part, wherein the cap and the fastening part have a mutual connection area comprising mutually cooperating, complementary conical surfaces of a self locking conicity, and cooperating annular complementary engaging means of which one is formed of a resilient yieldable material integral with the fastening part via an annular weakening area.

2. A cap unit according to claim 1, where the fastening part forms a separate part, wherein the fastening part comprises a shirt arranged at the lower end thereof and opposite its conical part for abutment against a shoulder of the container, said shirt being provided with at least one radially inwardly and upwardly extending locking barb for engagement with an annular bead arranged on an outer surface of the container.

3. A cap unit according to claim 2, wherein the shirt is further provided with a shirt weakening area adjacent said locking barb.

4. A cap unit according to claim 1 wherein an edge flange is wedged in between the end surface of the container and the fastening part for the one end of a dropper having a narrow outlet channel and an outlet channel orifice at the opposite end, the cap internally comprising a centrally and rounded projection being adapted to the outlet channel orifice as a closing plug thereof, and the distance between the internal projection and an abutment of the fastening part in the mounted position of the cap being adapted to the distance of the outlet channel orifice from the sealing collar at a non-folded length compressed position of the tube, so that the projection tightly closes the outlet channel orifice when the two conical parts are in their self locking mutual engagement.

5. A cap unit according to claim 1, wherein one of the conical parts has at least one annular cavity extending around its conical surface.

6. A cap unit according to claim 1, wherein the annular engaging means with the weakening area is provided with a tearing off flap and a transverse weakening zone at the flap.

7. A cap unit according to claim 6, wherein the tearing off flap is positioned on the cap immediately next to the weakening zone and at a transverse weakening zone.

8. A cap unit according to claim 1, wherein the engaging means comprise mutually cooperating saw tooth coggings with such a tooth inclining direction that the coggings, when the cap is turned in a possible unscrew direction for the fastening part, jumps over without the means being brought out of their mutual engagement.

9. A cap unit according to claim 1, wherein the cap is a foot cap on which the cap with a mounted fastening part may be placed in a turned vertical position.

10. A cap unit according to claim 1, wherein the conical surface of the one conical part comprises an annular bead which in the self locking mutual engagement of the conical surfaces of the conical parts are positioned with clearances in a corresponding annular cavity in the conical surface of the second conical part.

11. A cap unit according to claim 1 wherein the fastening part comprises a portion of the container neck.

12. A cap unit for a container, provided with a pliable dropper and comprising a cap for fastening on the container via a fastening part, wherein the cap and the fastening part in a mutual connection area comprise mutually cooperating, complementary conical surfaces of a self locking conicity, and cooperating annular complementary engaging means of which one is performed of a resilient yieldable material intergral with the cap via an annular weakening area, the fastening part forming a separate part to be mounted at the container neck, the fastening part furthermore comprising a shirt arranged at the lower end thereof and opposite its conical part for abutment against a shoulder of the container, said shirt being provided with at least two radially inwardly and upwardly extending locking barbs for engagement with an annular bead arranged on the outer surface of the container, one of the conical parts having at least one annular cavity extending around its conical surface, the annular engaging means with the weakening area being provided with a tearing off flap and a transverse weakening zone at the tag, and the conical surface of the other one of the conical parts comprising an annular bead, which engages an annular cavity in the conical surface of the first one of the conical parts before the conical parts engage in their mutually self-locking conical engagement.

13. A cap unit for a container provided with a pliable dropper, said container having a neck terminating in an open end, said container neck having threads on the outer surface and further having an annular bead extending from the outer surface at a point on the neck below said threads, said cap unit comprising a cap and a fastening part; said cap and said fastening part having a mutual connection area which comprises mutually cooperating, complementary conical surfaces of a self-locking conicity and cooperating annular complementary engaging means of which one is formed of a resilient, yieldable material integral with the fastening part via an annular weakening area; the fastening part being a separate, tubular part provided with a female thread on its inner surface for mounting on the container neck, said fastening part further comprising a shirt arranged at the lower end thereof and opposite its conical part for abutment against a shoulder of the container, said shirt being provided with at least two radially, inwardly and upwardly extending locking barbs for engagement with the annular bead on the outer surface of the container neck, said shirt further having a shirt weakening area adjacent said locking barbs;

wherein, one of the conical parts is provided with at least one annular cavity extending around its conical surface; and the annular engaging means with the weakening area is provided with a tearing off flap and a transverse weakening zone at the flap; and the conical surface of the other one of the conical parts comprising an annular projection which engages an annular cavity in the conical surface of the first one of the conical parts before the conical parts engage in their mutually self-locking conical engagement.

* * * * *